US006891545B2

(12) United States Patent
Dean

(10) Patent No.: US 6,891,545 B2
(45) Date of Patent: May 10, 2005

(54) COLOR BURST QUEUE FOR A SHARED MEMORY CONTROLLER IN A COLOR SEQUENTIAL DISPLAY SYSTEM

(75) Inventor: John E. Dean, Stormville, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 241 days.

(21) Appl. No.: 10/215,067

(22) Filed: Aug. 8, 2002

(65) Prior Publication Data

US 2003/0095126 A1 May 22, 2003

Related U.S. Application Data

(60) Provisional application No. 60/331,916, filed on Nov. 20, 2001.

(51) Int. Cl.[7] ..... G09G 5/36

(52) U.S. Cl. ..... 345/549; 345/591; 345/593; 345/603; 345/604

(58) Field of Search ..... 345/549, 584, 345/591, 593, 600, 603, 604, 605, 589

(56) References Cited

U.S. PATENT DOCUMENTS

| | | | | | |
|---|---|---|---|---|---|
| 4,914,508 | A | * | 4/1990 | Music et al. | 375/240.01 |
| 6,072,545 | A | * | 6/2000 | Gribschaw et al. | 348/756 |
| 6,396,596 | B1 | * | 5/2002 | Hosier et al. | 358/1.9 |
| 6,430,180 | B1 | * | 8/2002 | Bohm et al. | 370/369 |
| 2003/0169755 | A1 | * | 9/2003 | Ternovsky | 370/412 |

* cited by examiner

*Primary Examiner*—Matthew C. Bella
*Assistant Examiner*—Mackly Monestime

(57) ABSTRACT

A system and method for managing memory in display processing circuit for use with a color sequential display. The system comprises: a shared memory; and a storage queue coupled to the shared memory, wherein the storage queue includes: a system for receiving and storing alternating packets of color-specific video data in the storage queue; and a system for separately reading contiguous sets color-specific packets from the storage queue to the shared memory.

20 Claims, 4 Drawing Sheets

COLOR BURST QUEUE FOR A SHARED MEMORY CONTROLLER IN A COLOR SEQUENTIAL DISPLAY SYSTEM

CROSS-REFERENCE TO RELATED APPLICATION

This application claims the benefit of copending provisional application 60/331,916 filed on Nov. 20, 2001.

FIELD OF TECHNOLOGY

The present invention relates generally to memory storage in video display systems, and more particularly relates to a system and method for implementing a color burst queue for a shared memory controller in a color display system.

BACKGROUND AND SUMMARY

As the demand for devices having feature-rich video displays, such as laptops, cell phones, personal digital assistants, flat screen TV's, etc., continues to increase, the need for systems that can efficiently process video data has also increased. One of the many challenges involves managing the flow of video data from a video source to a video display. For example, systems: (1) may require different types of memory systems, including storage queues; (2) may utilized shared memory devices that require memory controllers to handle multiple real-time processes; (3) may be required to manage different types of data, etc.

A recent advance in video display technology in which the above-mentioned challenges arise involves color sequential display systems (i.e., color sequencing). Color sequencing utilizes a scrolling color architecture in which the red, green, and blue primary colors are sequentially presented to the same panel, using the same pixel locations. To implement such a system, the video data must be presented to the display panel at an elevated rate (e.g., a frame rate of 150–180 Hz) such that the viewer perceives a continuous full color image. The resulting speed and bandwidth requirements create challenges in designing an efficient low cost architecture for delivering video data from a source to the actual display.

For instance, storage queues that are used to buffer data going to or from a shared memory device are normally implemented as FIFO's (i.e., first-in first-out storage) or dual port memories that are addressed as FIFO's. In the case of a shared memory system that is used within a color sequential display, the color components must be separately processed, which implies three FIFO's, one for each color. This requirement of having three FIFO's adds to the cost and complexity of the system. Accordingly, a system and method are required in which multiple FIFO's are not needed.

The present invention addresses one or more of the above-mentioned problems, by providing a storage queue for a color sequential display system comprised of a single dual port memory that stores and retrieves color-specific video data and provides color separation. In a first aspect, the invention provides a storage queue for a color sequential display system, wherein the storage queue is coupled to a shared memory and comprises: a system for receiving and storing individual packets of alternating red, green and blue video data in the storage queue; and a system that can read out separate sets of red packets, green packets and blue packets from the storage queue to the shared memory.

In a second aspect, the invention provides a method of managing color sequential display data in a storage queue that is coupled to a shared memory, comprising: receiving and storing individual packets of alternating red, green and blue video data in the storage queue; and reading out separate sets of red packets, green packets and blue packets from the storage queue to the shared memory.

In a third aspect, the invention provides a memory management system for use in a color sequential display, comprising: a shared memory; and a storage queue coupled to the shared memory, wherein the storage queue includes: a system for receiving and storing individual packets of alternating color-specific video data in the storage queue; and a system for bursting separate sets of color-specific packets from the storage queue to the shared memory.

BRIEF DESCRIPTION OF THE DRAWING FIGURES

These and other features of this invention will be more readily understood from the following detailed description of the various aspects of the invention taken in conjunction with the accompanying drawings in which.

DETAILED DESCRIPTION

Figure 1:
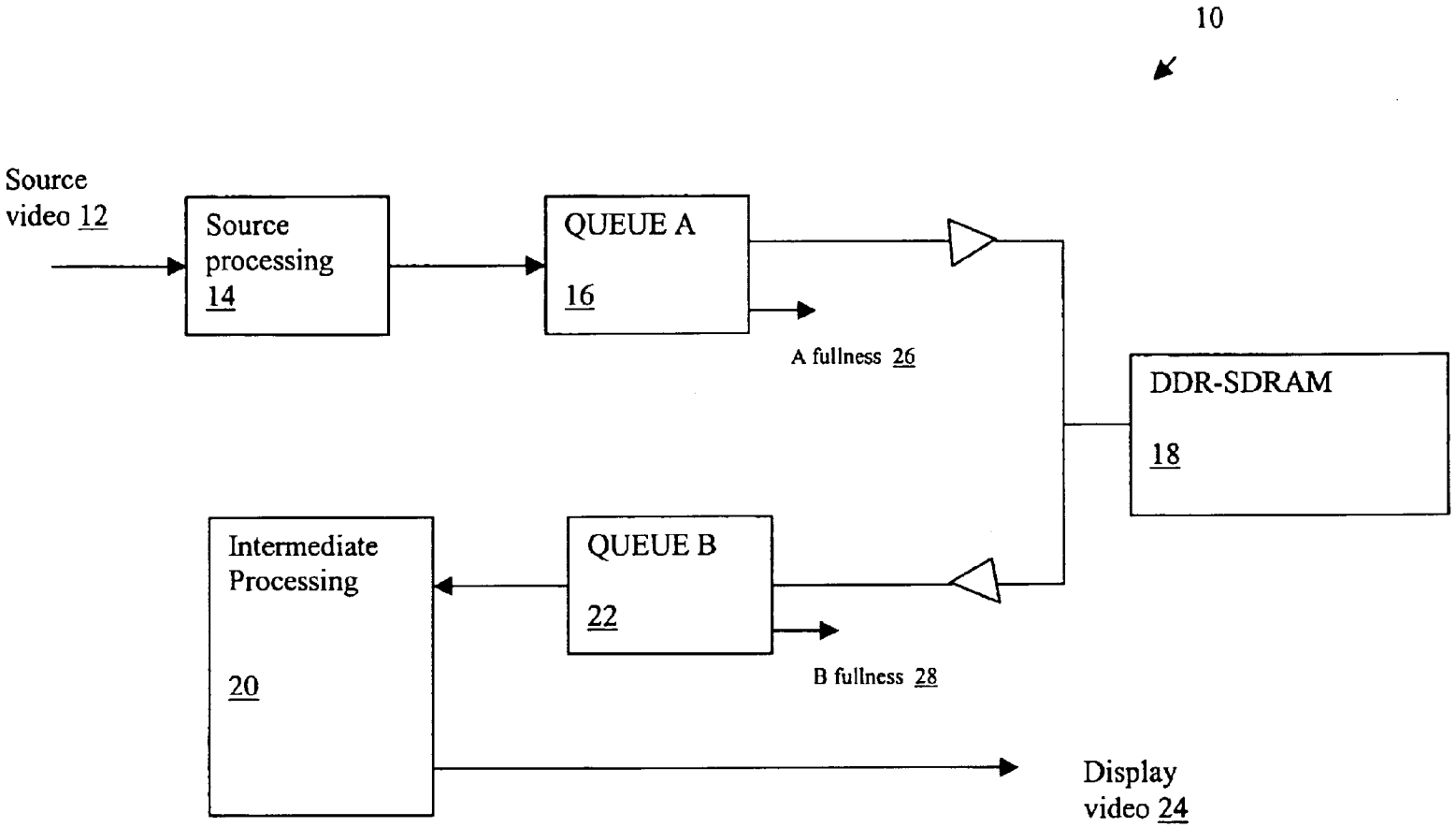
FIG. 1 depicts an exemplary video processing circuit in accordance with the present invention.

Referring now to the drawing, FIG. 1 depicts a display processing circuit 10 for a color sequential display system that receives a source video 12 and outputs a display video 24. Along the processing chain, video data may be processed by a source processing system 14 and an intermediate processing system 20. In addition, a pair of storage queues 16 and 22 is utilized to temporarily store data. Finally, a shared memory 18 is included in the circuit as, for instance, a frame memory to increase the frame rate from the source rate to the display rate. (The ratio of the display to source rate is typically greater than 1.)

The shared memory 18 may be implemented using a double data rate synchronous dynamic random access memory (DDR-SDRAM). Source video 12 arrives at a regular rate and is stored in queue A 16 prior to being burst into the shared memory 18. Queue B 22 is read at a regular rate. A scheduler (described below) monitors the fullness 26, 28 of both queues and decides when bursts should occur in order to guarantee that neither queue underflows or overflows. The present invention describes a system for controlling the memory associated with a source storage queue (i.e., queue A 16). More particularly, the present invention describes a system and method that can efficiently burst sets of color specific video data from a storage queue to a shared memory. It should be understood that the display processing circuit of FIG. 1 is depicted for exemplary purposes only, and other configurations utilizing the described invention in which a storage queue is coupled to a shared memory fall within the scope of the present invention.

Figure 2:
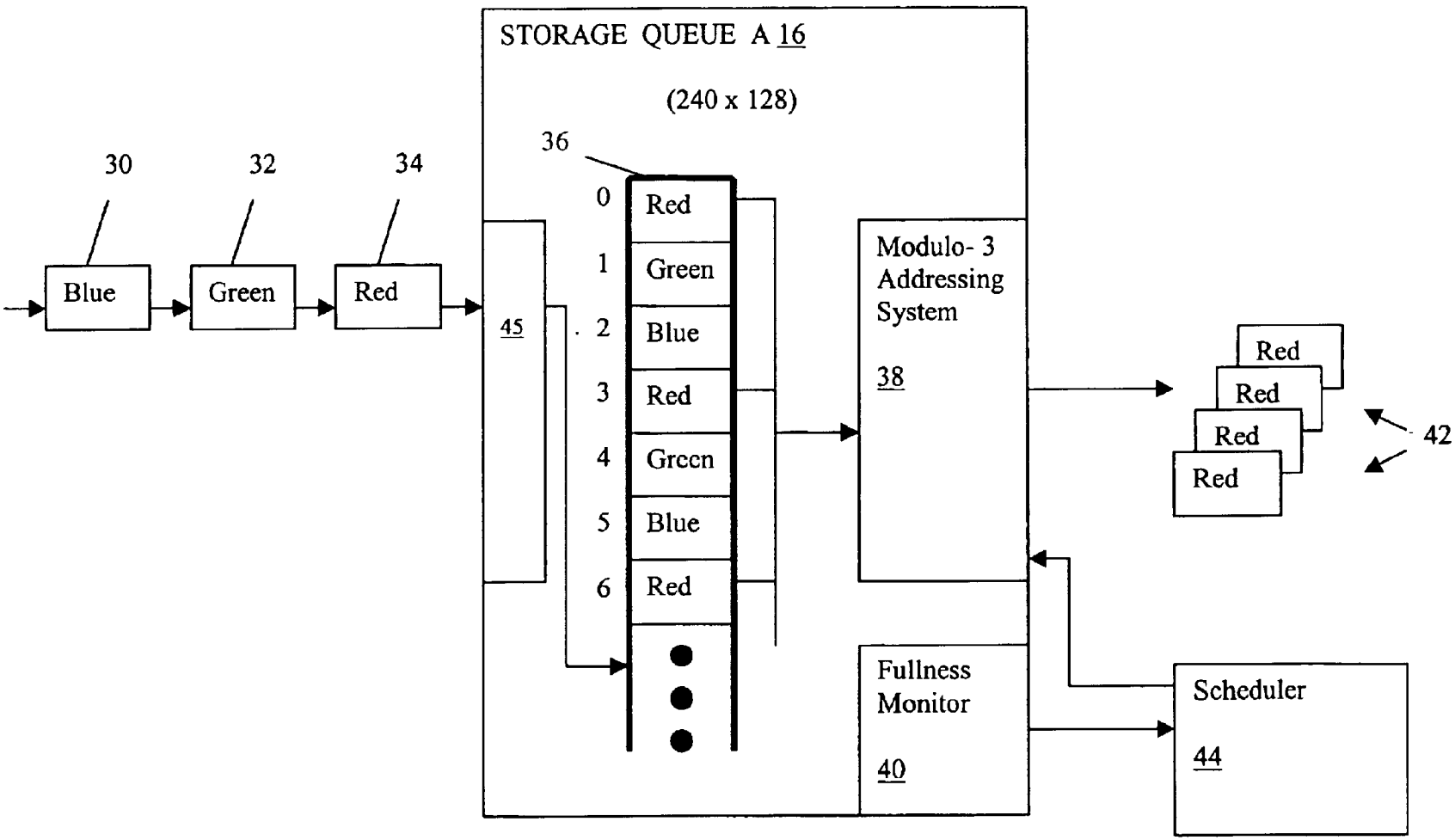
FIG. 2 depicts a memory control system for a storage queue in accordance with the present invention.

Referring now to FIG. 2, an exemplary embodiment of storage queue A 16 ("queue 16") is shown in greater detail. As can be seen, alternating packets of red 34, green 32 and blue 30 video data are individually received by queue A 16 in a sequential fashion. In this embodiment, each received packet generally comprises one 128-bit word, where each 128-bit word comprises 16 pixels of the same color, and queue 16 comprises a 240×128 bit memory 36 to store up to 240 packets of data. Obviously, other packet and memory sizes could be utilized. On the input, or write side of queue 16, a linear addressing system 45 stores the packets in memory 36 with a linear increment of one (i.e., the packets are stored contiguously in the order in which they are received).

On the output, or read side of queue 16, a modulo-3 addressing system 38 is utilized to select color specific sets of data that are to be burst to shared memory 18. The ability to burst color specific sets of data (e.g., red data set 42) is particularly advantageous in a color sequential system in which the three primary colors (red, green and blue) must be separated and stored at contiguous locations in the shared memory 18 in anticipation of different display presentation times.

Thus, as source video 12 arrives, it is parsed into alternating 128-bit words 36 of red, green and blue and stored in memory 36 of queue 16 using linear addressing (0, 1, 2, . . . ). The addressing sequence used to read data out of queue 16 is modulo-3 with a different starting value for each color (e.g., red=0, green=1, blue=2). Therefore, the first burst for a set of red data packets 42 from queue 16 to shared memory 18 will be addressed as 0, 3, 6, 9 . . . The second burst (not shown) for a set of green data packets will have an address sequence of 1, 4, 7, 10, . . . ; and the third burst (not shown) for a set of blue data packets will have an address sequence of 2, 5, 8, 11, . . . .

In a video display application having a line size of 1280 pixels, the shared memory bus is preferably 128-bits wide to meet the bandwidth requirements. Accordingly, for this exemplary embodiment, queue 16 utilizes a 240×128-bit architecture. Thus, three "virtual" FIFO's (red, green, and blue), each with a size of 80×128-bits are created using a single dual port memory. Obviously, the invention is not limited to a particular architecture as other memory sizes can be utilized to meet the particular requirements of a specific application.

In accordance with the invention, any practical burst size (e.g., 10–80 words) could be utilized. However, in this embodiment, a burst size of 40 words is utilized, therefore requiring 6 bursts to empty queue 16. In order to decrease the possibility of overflow of any of the colors, which could occur by leaving data in the queue too long, a scheduler 44 may be utilized to alternate colors on a round-robin basis, i.e., red 40, green 40, blue 40, red 40, green 40, blue 40.

Scheduler 44 also is responsible for granting access to shared memory 18. Specifically, scheduler 44 monitors a fullness 26, 28 of each queue 16, 22 (FIG. 1) and grants access to shared memory 18 for one of the queues when the queue fullness 26, 28 exceeds a predetermined threshold. Fullness may be determined by fullness monitor 40, which may for example count write and read transactions and calculate the number of unread words. Note however that because of the asymmetric addressing (i.e., modulo-3) used in the invention, the fullness threshold must be carefully selected. Namely, the fullness threshold must be selected on a case-by-case basis and will depend on the ratio of display bandwidth to source bandwidth, as well as the size of the queue.

The following is one exemplary embodiment for calculating a fullness threshold FT for storage queue 16 described above.

$$FT=240*(1-(Sf*Fcs/Bf*Fcm),$$

Where:

Fcs is the source clock frequency;

Fcm is the memory clock frequency;

Sf is a source efficiency factor (e.g., 0.75 indicating that a word is loaded three of every four clocks); and Bf is the burst factor: BL/(BL+8) where BL is the burst length and 8 is the approximate overhead between bursts.

Thus, for example, the fullness threshold FT for a queue having a source clock at 27 MHz, a memory clock of 68 MHz, and a burst length of 40 would be calculated as follows:

$$FT=240*(1-(0.75*27)/(0.833*68)=154,$$

where Bf=40/48=0.833.

Note that this calculation provides a minimum threshold at which reading at queue 16 should start (i.e., start reading from queue 16 when more than 154 words are stored in the queue). If reading starts sooner, then some of the data from the previous row may be read again (underflow). On the other hand, in order to guard against overflow, a maximum threshold should also be considered, i.e., the point at which reading the data is so late that some data from the new row will be skipped.

Figure 3:
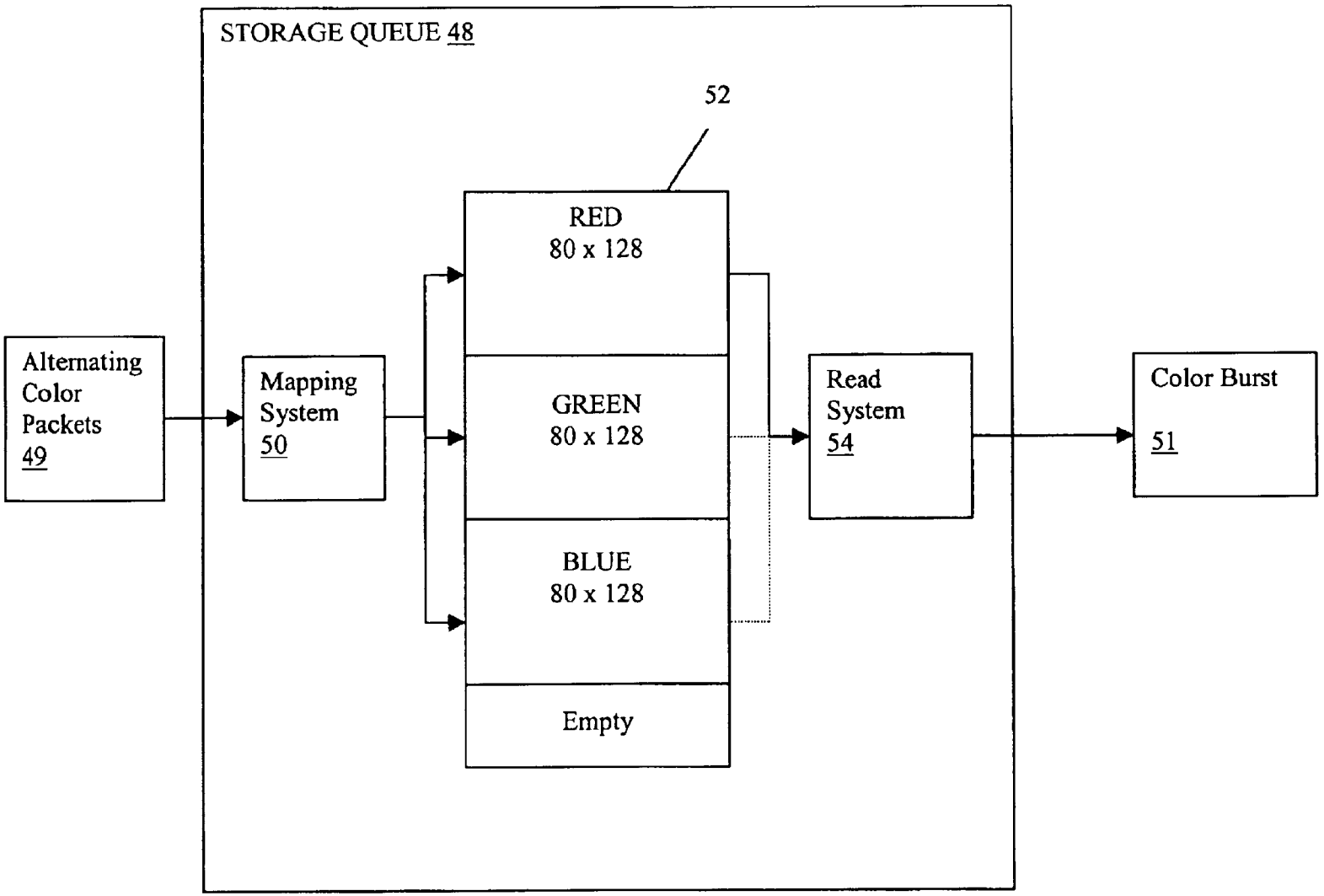
FIG. 3 depicts an alternate embodiment of a memory control system for a storage queue in accordance with the present invention.

Referring now to FIG. 3, an alternate embodiment of a storage queue memory system 48 is shown. In this case, the alternating color packets are input 49 to a mapping system 50 that maps the sequence color packets to color specific portions of the memory 52. Thus, all red color data is stored in the first 80 address locations (0–79), all green color data is stored in the next 80 address locations (80–159) and all blue color data is stored in the final 80 address locations (160–239). A linear read system 54 is then utilized, with an increment of 1, to address color-specific sets of color packets 52 from each color specific area of the memory 52.

Figure 4:
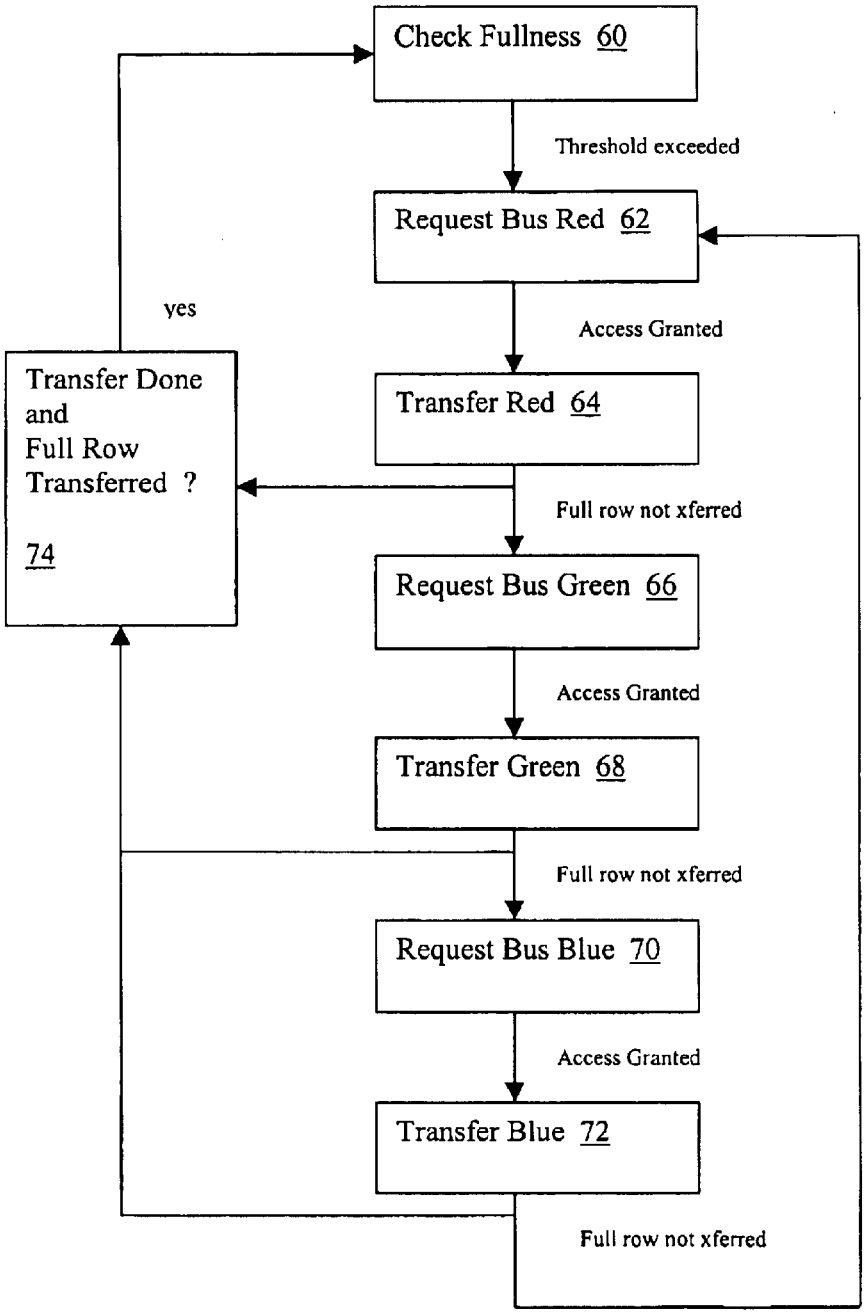
FIG. 4 depicts a flow diagram of a read controller method in accordance with the present invention.

Referring to FIG. 4, a flow diagram of the queue read control method is depicted. Control of these actions may be implemented by a state machine (not shown) in the scheduler 44. First, the fullness of the queue 16 is continuously checked 60. When the threshold is exceeded, a request for bus access for red is made 62. When the request is granted, a burst of red is transferred to the shared memory 64. After the transfer is done, a check is made to see if the full row has been transferred 74. If the full row has not been transferred, then a bus request for green is made 66. When the request is granted, green is transferred 68. Again, after the transfer is done, a check is made to see if the full row has been transferred 74. If the full row has not been transferred, then a bus request for blue is made 70. When the request is granted, a burst of blue is transferred to the shared memory 72. Again, after the transfer is done, a check is made to see if the full row has been transferred 74. If the full row has not been transferred, then a bus request for red is made 70, etc. If during any check it is determined that a full row has been transferred, then the state machine returns to a check fullness state 60.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

I claim:

1. A storage queue for a color sequential display system, wherein the storage queue is coupled to a shared memory and comprises:

a system for receiving and storing individual packets of alternating red, green and blue video data in the storage queue;

a system for reading out separate sets of red packets, green packets and blue packets from the storage queue to the shared memory; and a fullness detection system that determines when sets of packets are to be read from the storage queue based on a predetermined threshold.

2. The storage queue of claim 1, wherein the each packet comprises a word of color-specific video data.

3. The storage queue of claim 2, wherein each word comprises 128 bits.

4. The storage queue of claim 1, wherein:

each received packet is stored in a linear addressing fashion; and sets of packets are read out using a modulo-3 addressing sequence.

5. The storage queue of claim 1, wherein:

each received packet is mapped to a color specific portion of the storage queue; and sets of packets are read out of the color specific portion using a linear addressing sequence.

6. The storage queue of claim 1, wherein the storage queue comprises a single dual port memory.

7. The storage queue of claim 1, wherein each set of packets comprises between 10 and 80 packets.

8. A method of managing color sequential display data in a storage queue that is coupled to a shared memory, comprising:

receiving and storing individual packets of alternating red, green and blue video data in the storage queue;

reading out separate sets of red packets, green packets and blue packets from the storage queue to the shared memory;

measuring a fullness of the storage queue as data is being received by the storage queue; and causing data to be read out after fullness exceeds a threshold.

9. The method of claim 8, wherein:

each received packet is stored in a linear addressing fashion; and sets of packets are read out using a modulo-3 addressing sequence.

10. The method of claim 8, wherein:

each received packet is mapped to a color specific portion of the storage queue; and sets of packets are read out of the color specific portion using a linear addressing sequence.

11. The method of claim 8, wherein each set of packets is burst to the shared memory.

12. The method of claim 8, wherein each packet includes a 128-bit word of color-specific data, and each set of packets includes between 10 and 80 words.

13. A memory management system for use in color sequential display, comprising:

a shared memory;

a storage queue coupled to the shared memory;

a fullness monitor that measures a fullness of the storage queue; and a scheduler that grants access to the shared memory when the fullness exceeds a predetermined threshold;

wherein the storage queue includes:

a system for receiving and storing individual packets of alternating color-specific video data in the storage queue; and a system for bursting separate sets of color-specific packets from the storage queue to the shared memory.

14. The memory management system of claim 13, wherein the shared memory comprises a frame memory implemented as a double data rate synchronous dynamic random access memory (DDR-SDRAM).

15. The memory management system of claim 13, wherein the storage queue is implemented as a dual port memory.

16. The memory management system of claim 15, wherein the dual port memory stores each packet with a linear increment of 1 addressing mode and reads sets of packets out using a modulo-3 addressing sequence.

17. The memory management system of claim 15, wherein the dual port memory maps each received packet to a color specific portion of the storage queue, and reads our sets of packets using a linear addressing sequence.

18. The memory management system of claim 15, wherein the dual port memory comprises a 240×128 bit static random access memory.

19. The memory management system of claim 13, wherein the predetermined threshold FT is calculated using the formula:

$$FT=240*(1-(Sf*Fcs/Bf*Fcm),$$

where, Fcs is a source clock frequency, Form is a memory clock frequency; Sf is a source efficiency factor, and Bf is the burst factor defined as BL/(BL+n) where BL is the burst length and n is the approximate overhead between bursts.

20. The memory management system of claim 19, wherein n equals 8.

* * * * *